US009568863B1

(12) United States Patent
Takahashi

(10) Patent No.: US 9,568,863 B1
(45) Date of Patent: Feb. 14, 2017

(54) TRANSFER DEVICE AND IMAGE FORMING APPARATUS

(71) Applicant: FUJI XEROX CO., LTD., Tokyo (JP)

(72) Inventor: Yoshinori Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/996,680

(22) Filed: Jan. 15, 2016

(30) Foreign Application Priority Data

Aug. 27, 2015 (JP) ..... 2015-168032

(51) Int. Cl.
*G03G 15/16* (2006.01)

(52) U.S. Cl.
CPC ..... *G03G 15/1615* (2013.01); *G03G 15/161* (2013.01)

(58) Field of Classification Search
CPC . G03G 15/161; G03G 15/1615; G03G 15/168
USPC ..... 399/66, 301
See application file for complete search history.

(56) References Cited

U.S. PATENT DOCUMENTS

2005/0180785 A1 8/2005 Murakami et al.
2012/0134700 A1* 5/2012 Yamaki ..... G03G 15/161 399/71

FOREIGN PATENT DOCUMENTS

JP 2002-116642 A 4/2002
JP 2005-234465 A 9/2005
JP 2006-018043 A 1/2006
JP 2009-086140 A 4/2009
JP 2009-098507 A 5/2009
JP 2010-243829 A 10/2010

OTHER PUBLICATIONS

Aug. 2, 2016 Office Action issued in Japanese Patent Application No. 2015-168032.
Nov. 22, 2016 Office Action issued in Japanese Patent Application No. 2015-168032.

* cited by examiner

*Primary Examiner* — Hoang Ngo
(74) *Attorney, Agent, or Firm* — Oliff PLC

(57) ABSTRACT

Provided is a transfer device including a transfer member that transfers a toner image to a recording medium, a removing member that has a hardness higher than a hardness of the transfer member and includes a corner portion coming into contact with the transfer member, so as to remove a toner attached to the transfer member by rotation of the transfer member in one direction, and a driving section that rotates the transfer member in the direction and rotates the transfer member in a direction opposite to the direction after a transfer operation of the transfer member is terminated.

14 Claims, 8 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2015-168032 filed Aug. 27, 2015.

BACKGROUND

Technical Field

The present invention relates to a transfer device and an image forming apparatus.

When a removing member such as a cleaning blade which removes a toner attached to a transfer member, such as a secondary transfer roller, has a hardness higher than that of the transfer member, the transfer member is recessed at a contact portion with a corner portion of the removing member. When the transfer member is recessed at the contact portion with the corner portion of the removing member, the surface of the transfer member and the surface of the removing member forming a wedge-shaped gap at the contact portion come close to each other, compared to a configuration in which the contact portion is not recessed, and thus the gap becomes narrower. A toner entering the wedge-shaped gap may be stuck thereto due to frictional heat generated between the removing member and the transfer member and a pressing force of the removing member against the transfer member. In particular, when the wedge-shaped gap is narrow over a wide range, the toner tends to be crushed over a wide range, which results in a tendency for the toner to be stuck.

SUMMARY

According to an aspect of the invention, there is provided a transfer device including:

a transfer member that transfers a toner image from an intermediate transfer body to a recording medium;

a removing member that includes a corner portion coming into contact with the transfer member, so as to remove a toner attached to the transfer member by rotation of the transfer member in a first direction; and a driving section that rotates the transfer member in the first direction and rotates the transfer member in a second direction opposite to the first direction.

BRIEF DESCRIPTION OF THE DRAWINGS

Exemplary embodiments of the present invention will be described in detail based on the following figures, wherein.

DETAILED DESCRIPTION

Hereinafter, an example of an exemplary embodiment according to the present invention will be described with reference to the accompanying drawings.

Image Forming Apparatus 10

Figure 1:
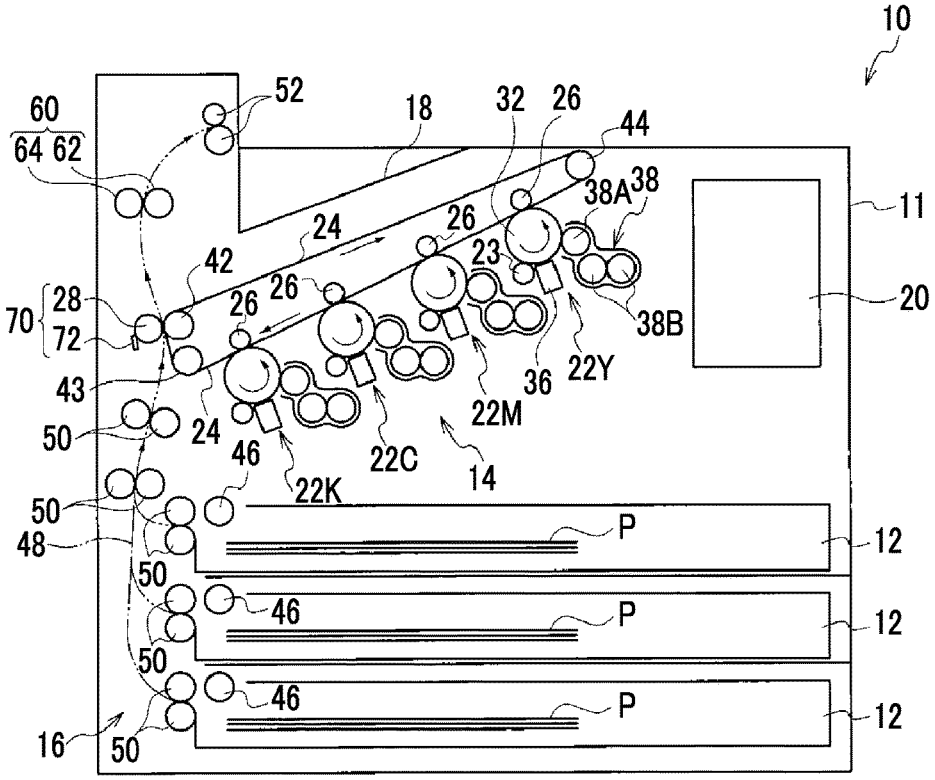
FIG. 1 is a schematic diagram illustrating a configuration of an image forming apparatus according to the present exemplary embodiment.

First, a configuration of an image forming apparatus 10 will be described. FIG. 1 is a schematic diagram illustrating a configuration of the image forming apparatus 10.

As illustrated in FIG. 1, the image forming apparatus 10 includes an image forming apparatus main body 11 (housing) having components accommodated therein. Plural accommodating portions 12 having a recording medium P such as paper accommodated therein, an image forming section 14 that forms an image on the recording medium P, and a fixing device 60 that fixes the image formed on the recording medium P onto the recording medium P are provided inside the image forming apparatus main body 11. Further, a transport section 16 that transports the recording medium P from the accommodating portion 12 to the image forming section 14 and a control section 20 that controls the operation of each section of the image forming apparatus 10 are provided inside the image forming apparatus main body 11. In addition, a discharge section 18 to which the recording medium P having an image fixed thereto by the fixing device 60 is discharged is provided in the upper portion of the image forming apparatus main body 11.

The image forming section 14 is configured to be able to form a marginless image, having no blank portion at the margin thereof, on the recording medium P. Specifically, the image forming section 14 includes image forming units 22Y, 22M, 22C, and 22K (hereinafter, referred to as 22Y to 22K) as examples of forming sections that form toner images of yellow (Y), magenta (M), cyan (C), and black (K) colors, and an intermediate transfer belt 24 (example of a transfer body) to which the toner images formed by the image forming units 22Y to 22K are transferred. Further, the image forming section 14 includes a transfer device 70 including a primary transfer roller 26 and a secondary transfer roller 28. The primary transfer roller transfers the toner image formed by the respective image forming units 22Y to 22K to the intermediate transfer belt 24, and the secondary transfer roller transfers the toner images, transferred to the intermediate transfer belt 24 by the primary transfer roller 26, from the intermediate transfer belt 24 to the recording medium P. Meanwhile, the image forming section 14 may have another configuration without being limited to the above-mentioned configuration, and may be configured to form an image on the recording medium P.

The image forming units 22Y to 22K are disposed inside the image forming apparatus main body 11 in a state of being inclined with respect to a horizontal direction. In addition, each of the image forming units 22Y to 22K includes a photoconductor 32 that is rotated in one direction (for example, counterclockwise in FIG. 1). Meanwhile, the image forming units 22Y to 22K are configured in the same manner, and thus a sign of each section in the image forming units 22M, 22C, and 22K is omitted in FIG. 1.

A charging roller 23 as a charging device that charges the photoconductor 32, an exposing device 36 that exposes the photoconductor 32 charged by the charging roller 23 to form an electrostatic latent image on the photoconductor 32, and a developing device 38 that develops the electrostatic latent image formed on the photoconductor 32 by the exposing device 36 to form a toner image are provided in the vicinity of each of the photoconductors 32 in order from an upstream side in a rotation direction of the photoconductor 32.

The exposing device 36 forms an electrostatic latent image based on an image signal transmitted from the control section 20. The image signal transmitted from the control section 20 includes, for example, an image signal acquired from an external device by the control section 20.

The developing device 38 includes a developer supply body 38A that supplies a developer to the photoconductor 32, and plural transport members 38B that transport the developer given to the developer supply body 38A while stirring the developer.

The intermediate transfer belt 24 is formed in an annular shape and is disposed on the upper side of the image forming units 22Y to 22K. Winding rollers 42, 43, and 44 having the intermediate transfer belt 24 wound thereon are provided on the inner circumferential side of the intermediate transfer belt 24. For example, the intermediate transfer belt 24 is circularly moved (rotated) in one direction (for example, clockwise in FIG. 1) while coming into contact with the photoconductor 32 by the rotation of the winding roller 44. Meanwhile, the winding roller 42 is configured as an opposite roller facing the secondary transfer roller 28.

The primary transfer roller 26 faces the photoconductor with the intermediate transfer belt 24 interposed therebetween. A position between the primary transfer roller 26 and the photoconductor 32 serves as a primary transfer position at which a toner image formed on the photoconductor 32 is transferred to the intermediate transfer belt 24.

A primary transfer voltage (primary transfer current) having a polarity opposite to that of a toner is applied to the primary transfer roller 26. Thereby, a primary transfer electric field is formed between the photoconductor 32 and the primary transfer roller 26, and thus an electrostatic force acts on the toner image formed on the photoconductor 32, thereby transferring the toner image to the intermediate transfer belt 24 at the primary transfer position.

The secondary transfer roller 28 of the transfer device 70 faces the winding roller 42 with the intermediate transfer belt 24 interposed therebetween. A position between the secondary transfer roller 28 and the winding roller 42 serves as a secondary transfer position at which a toner image transferred to the intermediate transfer belt 24 is transferred to the recording medium P.

A secondary transfer voltage (secondary transfer current) having a polarity which is the same as that of a toner is applied to the winding roller 42. Thereby, a secondary transfer electric field is formed between the winding roller and the secondary transfer roller 28, and thus an electrostatic force acts on the toner image of the intermediate transfer belt 24, thereby transferring the toner image to the recording medium P at the secondary transfer position.

The transport section 16 includes a sending-out roller 46 that sends out the recording medium P accommodated in the accommodating portion 12, a transport path 48 through which the recording medium P sent out to the sending-out roller 46 is transported, and plural transport rollers 50 that transport the recording medium P, disposed along the transport path 48 and sent out by the sending-out roller 46, to the secondary transfer position.

The fixing device 60 is disposed on a downstream side in a transport direction with respect to the secondary transfer position. The fixing device 60 fixes the toner image, transferred from the intermediate transfer belt 24 to the recording medium P, onto the recording medium P by heat of a heating roller 62 and pressing of a pressing roller 64.

Next, an image forming operation of forming an image on a recording medium P in the image forming apparatus 10 according to the present exemplary embodiment will be described.

In the image forming apparatus 10 according to the present exemplary embodiment, the recording medium P sent out from the accommodating portion 12 by the sending-out roller 46 is sent into the secondary transfer position by the plural transport rollers 50.

On the other hand, in the image forming units 22Y to 22K, the photoconductor 32 charged by the charging roller 23 is exposed by the exposing device 36, thereby forming an electrostatic latent image on the photoconductor 32. The electrostatic latent image is developed by the developing device 38, thereby forming a toner image on the photoconductor 32. The toner images of the respective colors which are formed by the image forming units 22Y to 22K are transferred to the intermediate transfer belt 24 at the primary transfer position, thereby forming a color image. The color image formed on the intermediate transfer belt 24 is transferred to the recording medium P at the secondary transfer position.

The recording medium P having the toner image transferred thereto is transported to the fixing device 60, and the transferred toner image is fixed by the fixing device 60. The recording medium P having the toner image fixed thereto is discharged to the discharge section 18 by a transport roller 52. As described above, a series of image forming operations is performed.

Here, when a marginless toner image is formed on the recording medium P, a toner image having a size larger than the size of the recording medium P is formed on the photoconductor 32 of each color so that a blank portion is not formed in a margin of the recording medium P. The toner image is transferred to the intermediate transfer belt 24 and is then transferred to the recording medium P. In this manner, since the size of the toner image transferred to the intermediate transfer belt 24 is larger than the size of the recording medium P, the toner image remains in the intermediate transfer belt 24, and the toner image transfers to the surface of the secondary transfer roller 28 from the intermediate transfer belt 24. In the present exemplary embodiment, in order to suppress the transfer of the toner image of the secondary transfer roller 28 to the rear surface (surface on a side opposite to the surface on which an image is formed) of the recording medium P, a toner attached to the surface of the secondary transfer roller 28 is removed by a blade 72 as described later.

Transfer Device 70

Next, a configuration of the transfer device 70 according to the present exemplary embodiment will be described.

Figure 2:
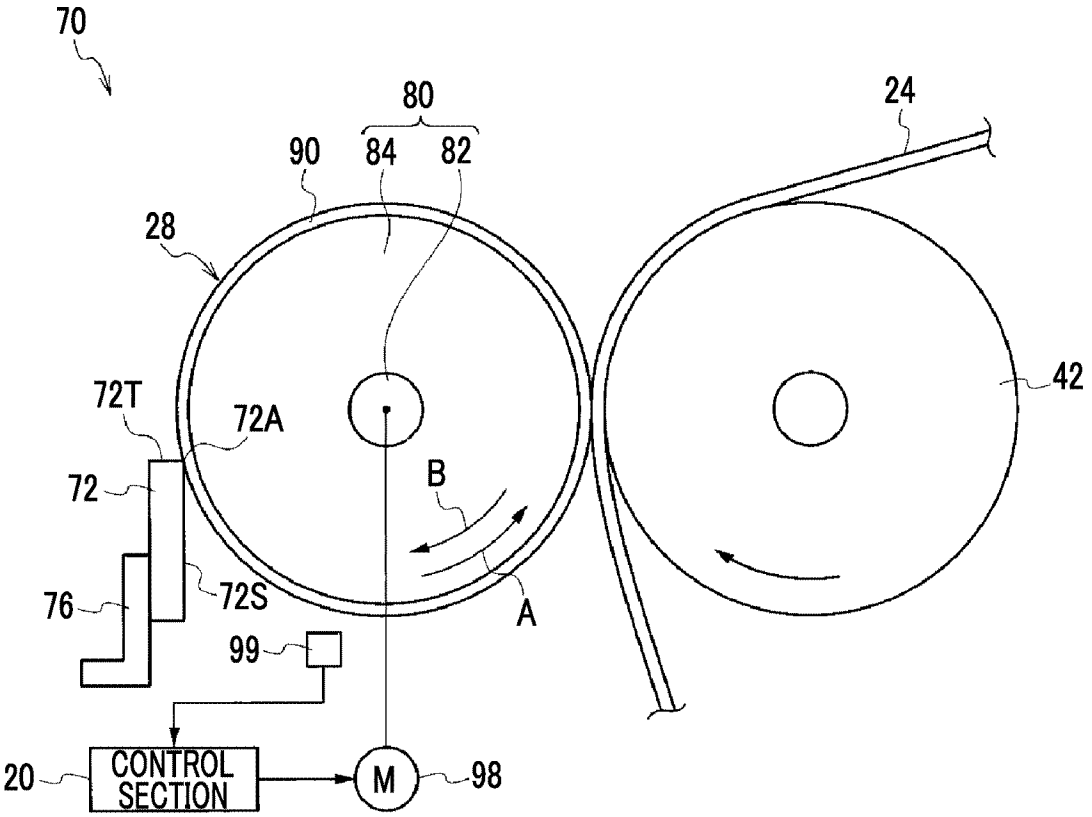
FIG. 2 is a schematic diagram illustrating a configuration of a transfer device according to the present exemplary embodiment.

FIG. 2 is a schematic diagram illustrating a configuration of the transfer device 70 according to the present exemplary embodiment As illustrated in FIG. 2, the transfer device 70 includes the above-mentioned secondary transfer roller 28 (example of a transfer member) and the blade 72 (example of a removing member) which removes a toner attached to the secondary transfer roller 28. Further, the transfer device 70 includes a driving section 98 that rotates the secondary transfer roller 28, and a thermometer 99 that measures the ambient temperature of the secondary transfer roller 28. Meanwhile, when the thermometer 99 is provided inside the image forming apparatus main body 11, the thermometer may not be disposed in the vicinity of the secondary transfer roller 28. Hereinafter, specific configurations of the secondary transfer roller 28, the blade 72, and the driving section 98 will be described.

Secondary Transfer Roller 28

The secondary transfer roller 28 includes an elastic roller 80 and a cylindrical tube 90 that covers the outer circumference of the elastic roller 80 and has conductivity. The elastic roller 80 includes a cylindrical or columnar support 82 (shaft) having conductivity, and an elastic layer 84 which is provided on the outer circumferential surface of the support 82 and has conductivity. Hereinafter, specific configurations of the support 82, the elastic layer 84, and the tube 90 will be described.

Support 82

The support 82 includes metal members such as iron (free-cutting steel or the like), copper, brass, stainless steel, aluminum, and nickel. In addition, as the support 82, for example, a member having subjected to plating on the external surface thereof (for example, a resin or a ceramic member), a member having a conductive agent dispersed therein (for example, a resin or a ceramic member), or the like may be used.

Elastic Layer 84

The elastic layer 84 is configured to include, for example, a rubber material (elastic material) and a foaming agent, and to include a conductive agent and other additives when necessary.

The rubber material includes, for example, a so-called elastic material having at least a double bond in a chemical structure. Specifically, examples of the rubber material may include isoprene rubber, chloroprene rubber, epichlorohydrin rubber (ECO), butyl rubber, polyurethane rubber, silicone rubber, fluororubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber (NBR), natural rubber, and rubber obtained by mixing these subber materials.

Examples of the foaming agent may include benzenesulfonyl hydrazide, azodicarbonamide (ADCA), N, N'-dinitrosopentamethylene tetramine, dinitroso pentamethylene tetramine (DPT), dinitrosopentamethylene styrene tetramine and benzene sulfonyl hydrazide derivatives, oxybisbenzenesulfonyl hydrazide (OBSH); ammonium bicarbonate, sodium bicarbonate, ammonium carbonate that generate carbon dioxide; a nitrososulfonylazo compound, N,N'-dimethyl-N,N'-dinitroso phthalic amide, toluenesulfonylhydrazide, P-toluenesulfonyl semicarbazide, P,P'-oxybis(benzenesulfonyl semicarbazide) that generate nitrogen, and the like.

The conductive agent is used depending on necessity in a case where the rubber material has a low conductivity, a case where the rubber material does not have conductivity, or the like. Examples of the conductive agent include an ion conductive agent and an electroconductive agent such as carbon black.

Other additives may include materials such as a foaming aid, a softener, a plasticizer, a curing agent, a vulcanizing agent, a vulcanization accelerator, an antioxidant, a surfactant, a coupling agent, a filler (silica, calcium carbonate, or the like) which may be generally added to an elastic layer.

The hardness of the elastic layer 84 is set to, for example, equal to or higher than 10 degrees and equal to or lower than 40 degrees. Meanwhile, hardness in the present exemplary embodiment is hardness measured based on an Asker C method. Hardness described below is also hardness measured based on an Asker C method.

Tube 90

The tube 90 may include resin materials such as polyimide, polyphenylene sulfide, polyether sulfide, polyetherimide, and polyarylate. The conductive agent contained in the tube 90 includes a conductive agent such as carbon black.

The hardness of the tube 90 is higher than the hardness of the elastic layer 84 and is set to, for example, equal to or higher than 20 degrees and equal to or lower than 50 degrees. Meanwhile, the hardness of the opposite roller 42 is higher than the hardness of the tube 90 and is set to, for example, equal to or higher than 70 degrees and equal to or lower than 80 degrees.

Blade 72

The blade 72 is formed of an elastic material and has a cross section in a longitudinal direction which is formed in a rectangular shape. In addition, the elastic material may include rubber materials such as polyurethane rubber, silicone rubber, fluororubber, ethylene, propylene, and diene rubber.

One end side of the blade 72 is fixed to a metal plate 76 as a support having an L shape in a cross-sectional view, through bonding.

The hardness of the blade 72 is higher than the hardness of the tube 90 and the hardness of the elastic layer 84, and is set to, for example, equal to or higher than 60 degrees and equal to or lower than 90 degrees.

Figure 3:
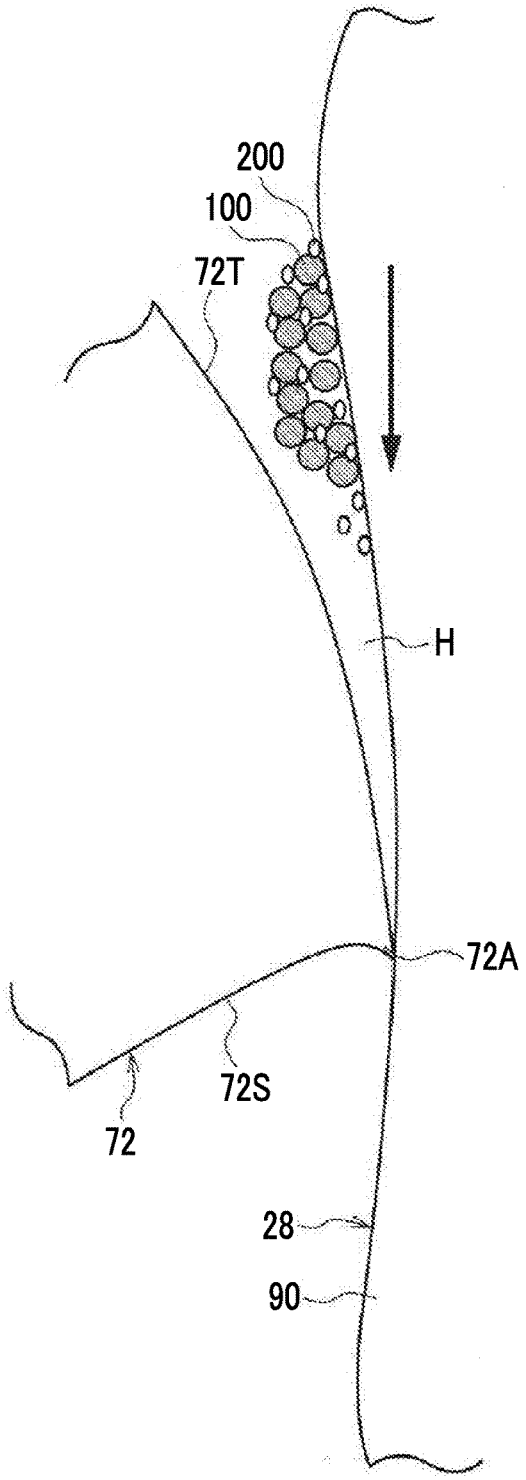
FIG. 3 is a schematic diagram illustrating a mode in which a toner and a medium component enter a gap between a secondary transfer roller and a blade.

The blade 72 is configured such that an edge 72A (example of a corner portion) formed by an end face 72T (upper surface) and a lateral side 72S on the side facing the secondary transfer roller 28 comes into contact with the surface of the tube 90 of the secondary transfer roller 28. As described above, since the hardness of the blade 72 is higher than the hardness of the tube 90 and the hardness of the elastic layer 84, the contact portion of the secondary transfer roller 28 is recessed as illustrated in FIG. 3. That is, a contact region configured as a curved surface biting into the secondary transfer roller 28 is formed.

In the blade 72, the secondary transfer roller 28 is rotated in one direction (direction of an arrow A in FIG. 2) by the driving section 98 in a state where the edge 72A comes into contact with the surface of the secondary transfer roller 28, and thus a toner attached to the surface of the secondary transfer roller 28 is removed. Meanwhile, in the blade 72, the edge 72A is pulled to the side (lower side) in the direction of the arrow A by the rotation of the secondary transfer roller 28, and the end face 72T (upper surface) is deformed to face the secondary transfer roller 28 side (right side) (see FIG. 3).

Driving Section 98

As illustrated in FIG. 2, the driving section 98 is configured to be capable of rotating (forward rotation) the secondary transfer roller 28 in one direction (direction of the arrow A) and rotating (backward rotation) the secondary transfer roller 28 in a direction (direction of an arrow B) opposite to the one direction.

Specifically, the control section 20 performs the forward rotation of the secondary transfer roller 28 in a transfer operation of transferring a toner image of the intermediate transfer belt 24 to the recording medium P. In addition, when a continuous rotation time in one direction in the transfer operation of the secondary transfer roller 28 is equal to or more than a predetermined time, the control section 20 performs the backward rotation of the secondary transfer roller 28 after the transfer operation is terminated.

More specifically, the control section 20 uses a time A (for example, 40 seconds), as an example of a first time, as the predetermined time at an environmental temperature A (for example, equal to or higher than 23° C.) as an example of a first environmental temperature, and uses a time B (for example, 100 seconds), as an example of a second time longer than the time A, as the predetermined time at an environmental temperature B (for example, equal to or higher than 10° C. and lower than 23° C.) as an example of a second environmental temperature lower than the environmental temperature A.

Further, the control section 20 uses a time C (for example, 280 seconds), as an example of a third time longer than the time B, as the predetermined time at an environmental temperature C (for example, less than 10° C.) as an example of a third environmental temperature lower than the environmental temperature B. The environmental temperature A, the environmental temperature B, and the environmental temperature C are measured by the thermometer 99. Meanwhile, the environmental temperature B, the environmental temperature C, the time B, and the time C described above may be ascertained as examples of the first environmental temperature, the second environmental temperature, the first time, and the second time, respectively.

In addition, a driving distance (rotation distance of the secondary transfer roller 28) of the backward rotation of the control section 20 is set to equal to or greater than 100 μm and equal to or less than 180 μm. Meanwhile, a specific control procedure of the backward rotation of the secondary transfer roller 28 by the control section 20 will be described in action to be described later.

Action According to Exemplary Embodiment

Next, a description will be given of a case where a marginless toner image is formed on a recording medium P, as action according to the exemplary embodiment.

When a marginless toner image is formed on a recording medium P, a toner image having a size larger than the size of the recording medium P is formed on the photoconductor 32 of each color. The toner image is transferred to the intermediate transfer belt 24 and is then transferred to the recording medium P. In this manner, since the size of the toner image transferred to the intermediate transfer belt 24 is larger than the size of the recording medium P, the toner image remains in the intermediate transfer belt 24, and a toner is transferred from the intermediate transfer belt 24 to the surface of the secondary transfer roller 28 at the secondary transfer position.

In addition, for example, calcium carbonate (hereinafter, referred to as a medium component) as a component contained in the recording medium P is attached to the secondary transfer roller 28 at the secondary transfer position by an electrostatic force in a secondary transfer electric field.

The toner and the medium component transferred to the secondary transfer roller 28 are removed by the blade 72.

Here, a toner 100 and a medium component 200 transferred to the secondary transfer roller 28 enter a wedge-shaped (triangular shape in a side view) gap H between the blade 72 and the secondary transfer roller 28 as illustrated in FIG. 3.

Figure 4:
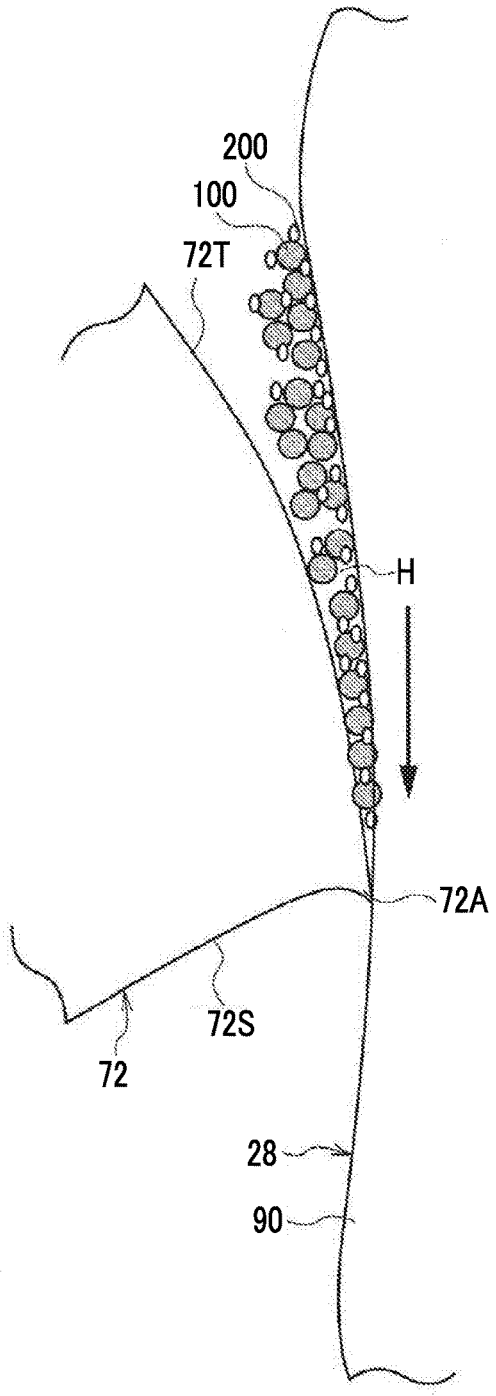
FIG. 4 is a schematic diagram illustrating a state where a toner and a medium component enter a gap between a secondary transfer roller and a blade.

In a general toner, an external additive having a small particle size is attached to the outer circumference thereof. However, since the external additive is hardly transported up to the secondary transfer position, the external additive does not enter the gap H, and thus there is nothing that restricts the entrance of the toner 100 and the medium component 200 to the gap H. For this reason, the toner 100 and the medium component 200 enter the inside of the gap H as illustrated in FIG. 4.

Figure 5:
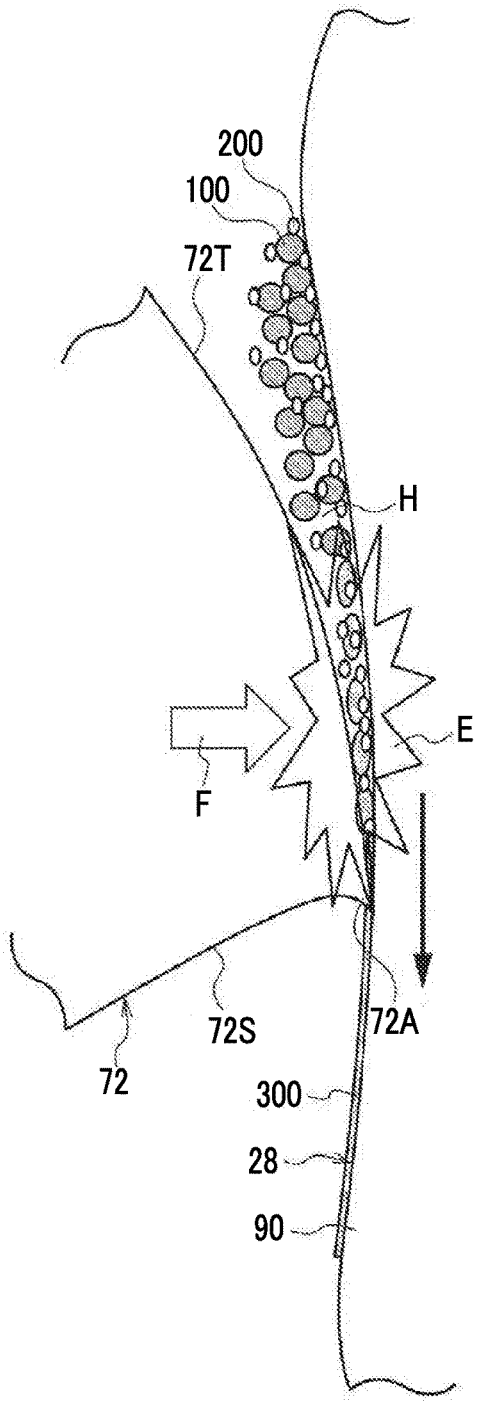
FIG. 5 is a schematic diagram illustrating a mode in which frictional heat and a pressing force act on a toner and a medium component which enter a gap between a secondary transfer roller and a blade.

In a configuration in which the driving of the secondary transfer roller 28 is always maintained in a stopped state after a transfer operation is terminated (comparative example), that is, a configuration in which the backward rotation of the secondary transfer roller 28 is not performed, frictional heat E between the blade 72 and the secondary transfer roller 28 and a pressing force F of the blade 72 against the secondary transfer roller 28 act on the toner 100 entering the gap H as illustrated in FIG. 5. Thereby, the toner 100 is melted, and thus is crushed. For this reason, the toner 100 and the medium component 200 are stuck to each other, and a thin film 300 is formed on the secondary transfer roller 28.

Figure 6:
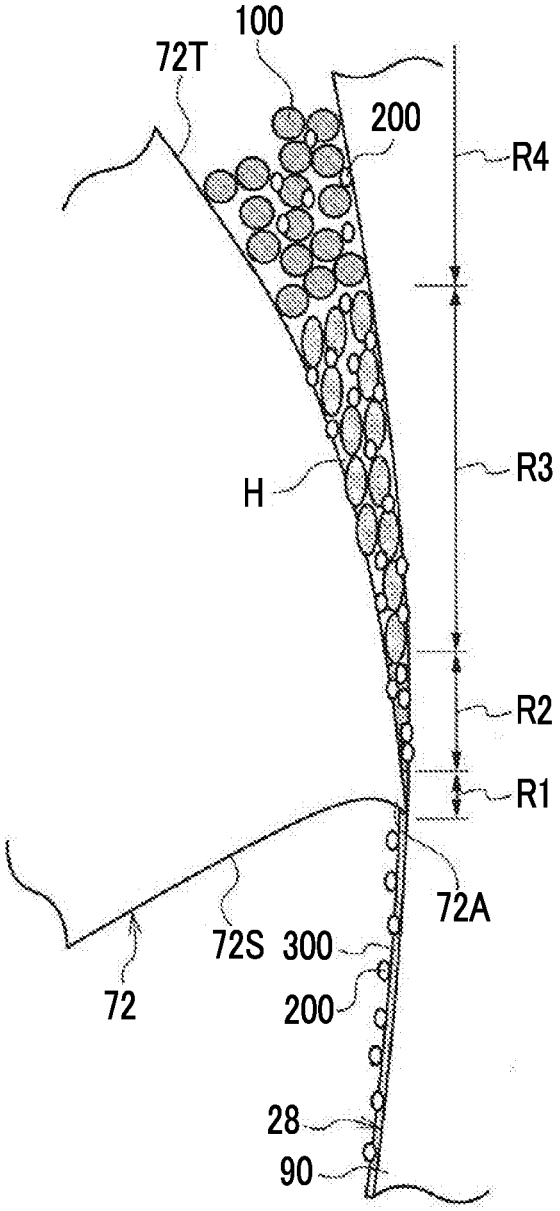
FIG. 6 is a schematic diagram illustrating modes of a toner and a medium component after frictional heat and a pressing force act, in a gap between a secondary transfer roller and a blade.

As illustrated in FIG. 6, the medium component 200 is further attached to the thin film 300 whenever the thin film passes through the gap H by the rotation of the secondary transfer roller 28, the film thickness of the thin film 300 becomes larger to such an extent as to be visually confirmable. Meanwhile, when the gap H is observed in the state illustrated in FIG. 6, the blade 72 and the secondary transfer roller 28 come into contact with each other in a region R1 (for example, a region of 5 μm), and the toner 100 which is crushed and aggregated and the medium component 200 are present in a region R2 (for example, a region of equal to or greater than 15 μm and equal to or less than 20 μm). Further, the toner 100 which is crushed but not aggregated and the medium component 200 are present in a region R3 (for example, a region of 60 μm), and the toner 100 which is not crushed and the medium component 200 are present in a region R4.

On the other hand, in the present exemplary embodiment, when the control section 20 acquires an image forming instruction, the backward rotation of the secondary transfer roller 28 is performed by the control section 20 (see FIG. 7) as follows in a case where the environmental temperature measured by the thermometer 99 is the environmental temperature A (for example, equal to or higher than 23° C.)

Figure 7:
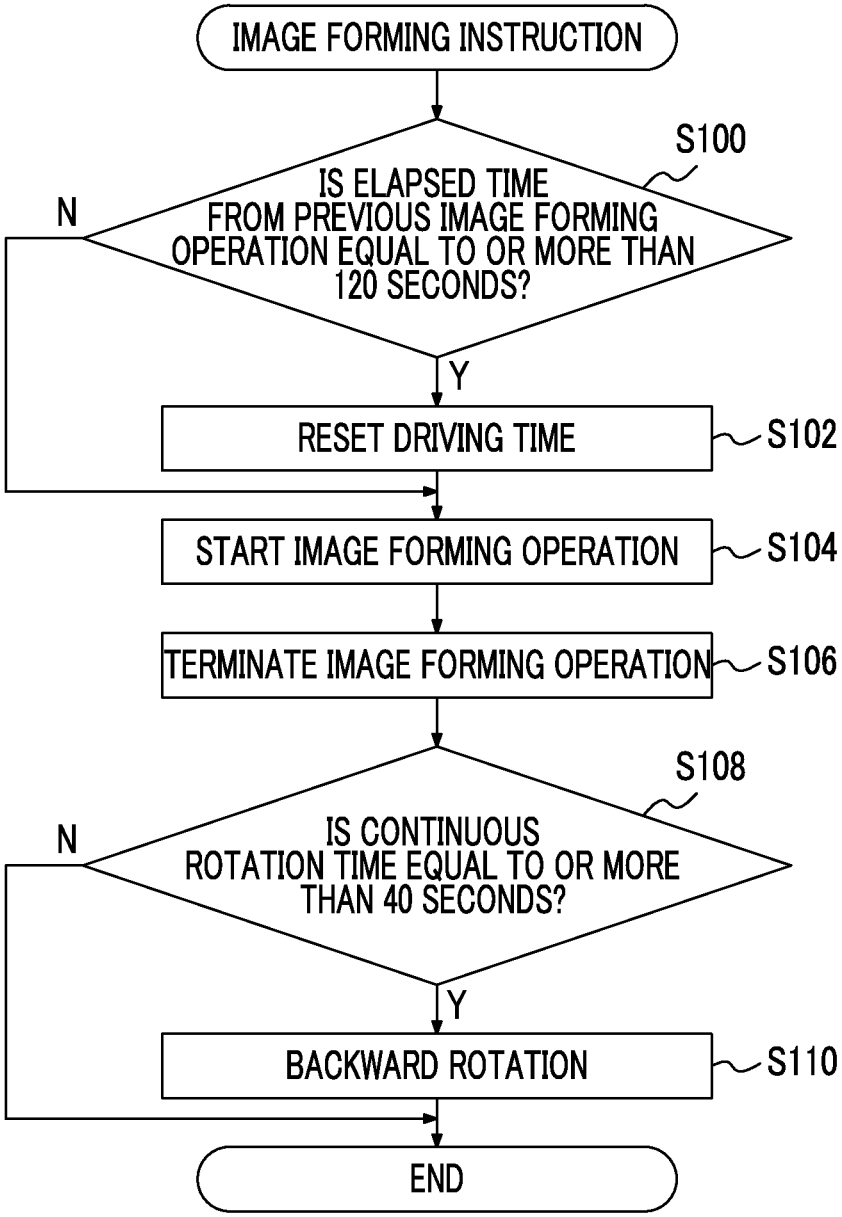
FIG. 7 is a flow chart illustrating a specific control procedure of the backward rotation of a secondary transfer roller by a control section.

As illustrated in FIG. 7, when the control section 20 acquires an image forming instruction, it is determined whether an elapsed time from the previous image forming operation is equal to or more than 120 seconds (step 100). As a result of the determination, when the elapsed time is less than 120 seconds, the flow proceeds to step 104 to start an image forming operation.

Specifically, the wording "elapsed time" as used herein refers to a time from the termination of the previous image forming operation to the start of an image forming operation to be performed.

As a result of the determination in step 100, when the elapsed time is equal to or more than a first elapsed time (for example, 120 seconds), a continuous rotation time of the secondary transfer roller 28 is reset (step 102) to start the image forming operation (step 104).

When the image forming operation is terminated (step 106), it is determined whether the continuous rotation time of the secondary transfer roller 28 is equal to or more than a first predetermined time (for example, 40 seconds) (step 108).

Meanwhile, when the reset in step 102 is performed, it is determined whether only the continuous rotation time of the secondary transfer roller 28 in the image forming operation is equal to or more than the first time. When the reset in step 102 is not performed, it is determined whether a time obtained by adding a continuous rotation time of the secondary transfer roller 28 in the previous image forming operation to the continuous rotation time of the secondary transfer roller 28 in the image forming operation is equal to or more than 40 seconds. That is, when an interval from the previous image forming operation has not elapsed the first elapsed time or more (when the interval is short), the continuous rotation time in the previous image forming operation is added on the assumption that the secondary transfer roller is continuously rotated.

As a result of the determination, when the continuous rotation time is equal to or more than the first time, the backward rotation of the secondary transfer roller 28 is performed (step 110). As a result of the determination, when the continuous rotation time is less than the first time, the backward rotation of the secondary transfer roller 28 is not performed. The secondary transfer roller 28 is rotated in a range from equal to or greater than 100 μm and equal to or less than 180 μm by the execution of the backward rotation of the secondary transfer roller 28.

For example, a time from the start of a transfer operation performed by the secondary transfer roller 28 to the termination of the transfer operation is set to be the continuous rotation time on the assumption that the secondary transfer roller 28 is rotated from when the transfer operation is started to when the transfer operation is terminated. In addition, the continuous rotation time may be obtained from the number of images formed on the recording medium P in the image forming operation. Further, the continuous rotation time of the secondary transfer roller 28 may be directly measured by a sensor (detection section).

Meanwhile, when the environmental temperature measured by the thermometer 99 is the environmental temperature B (for example, equal to or higher than 10° C. and lower than 23° C.) which is lower than the environmental temperature A, a reference elapsed time and a reference continuous rotation time are changed as follows. That is, a second elapsed time (for example, 60 seconds) which is shorter than the first elapsed time is used instead of the first elapsed time, and a second time (for example, 100 seconds) which is longer than the first time is used instead of the first time.

In addition, when the environmental temperature measured by the thermometer 99 is the environmental temperature C (for example, lower than 10° C.) which is lower than the environmental temperature B, a reference elapsed time and a reference continuous rotation time are changed as follows. That is, a third elapsed time (for example, 20 seconds) which is shorter than the second elapsed time is used instead of the first elapsed time, and a third time (for example, 280 seconds) which is longer than the second time is used instead of the first time.

In the present exemplary embodiment, as described above, after the image forming operation is terminated, that is, after the transfer operation of the secondary transfer roller 28 is terminated, the secondary transfer roller 28 is rotated backward under predetermined conditions.

Figure 8:
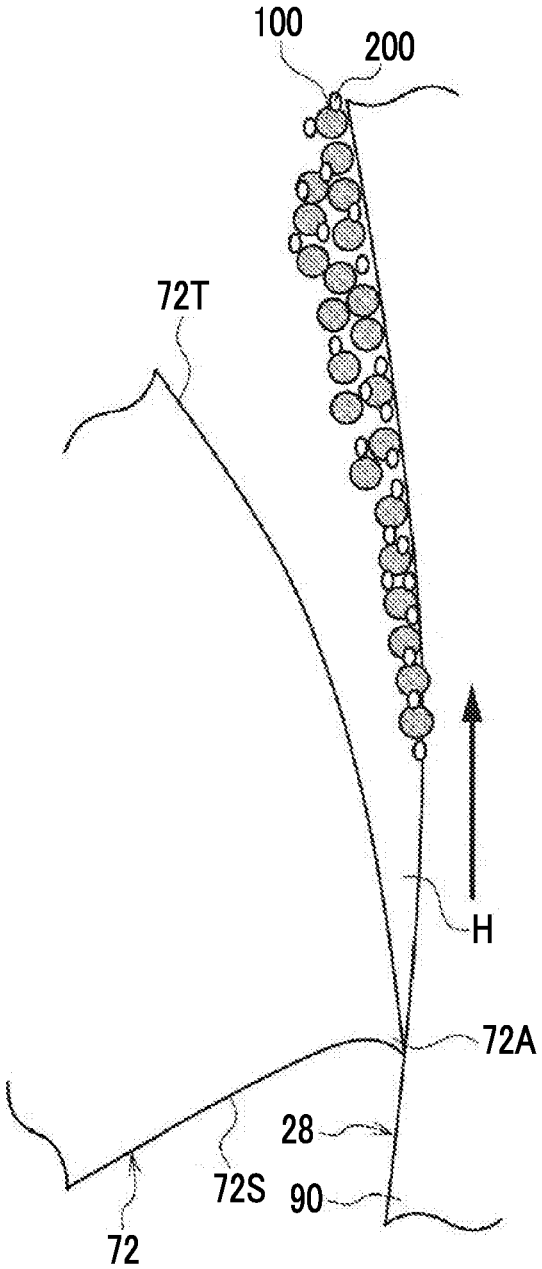
FIG. 8 is a schematic diagram illustrating modes of a toner and a medium component in a gap between a secondary transfer roller and a blade when the secondary transfer roller is rotated backward.

Thereby, as illustrated in FIG. 8, the toner 100 and the medium component 200 entering the inside of the wedge-shaped gap H between the blade 72 and the secondary transfer roller 28 are moved to the front side of the gap H. For this reason, frictional heat generated between the blade 72 and the secondary transfer roller 28 and a pressing force of the blade 72 against the secondary transfer roller 28 are not likely to act on the toner 100 and the medium component 200, and thus the toner is not likely to be crushed. Therefore, the sticking of the toner to the secondary transfer roller 28 is suppressed, compared to a configuration in which the secondary transfer roller 28 is not rotated backward.

In addition, in the present exemplary embodiment, when the continuous rotation time of the secondary transfer roller 28 is equal to or more than the first predetermined time (for example, 40 seconds), the secondary transfer roller 28 is rotated backward after the transfer operation is terminated. For this reason, a secondary obstacle due to the backward rotation of the secondary transfer roller 28 is suppressed, compared to a configuration in which the secondary transfer roller 28 is always rotated backward after the transfer operation is terminated.

Further, in the present exemplary embodiment, a reference continuous rotation time is determined in accordance with the environmental temperature, and the secondary transfer roller 28 is rotated backward after the termination of the transfer operation, in a case of being equal to or more than the determined continuous rotation time. For this reason, a secondary obstacle due to the backward rotation of the secondary transfer roller 28 is suppressed, compared to a configuration in which the secondary transfer roller 28 is always rotated backward after the transfer operation is terminated, under the same conditions regardless of an environmental temperature.

Meanwhile, as the secondary obstacle, for example, it is considered that the lateral side 72S of the blade 72 is pulled in a direction of the backward rotation of the secondary transfer roller 28 by the backward rotation of the secondary transfer roller 28, and is worn out by the surface of the secondary transfer roller 28. When the lateral side 72S of the blade 72 is worn out, the contact pressure of the blade 72 with respect to the secondary transfer roller 28 is lowered, and thus a toner removal failure may occur.

In addition, in the present exemplary embodiment, a driving distance (rotation distance of the secondary transfer roller 28) of the backward rotation of the control section 20 is set to equal to or greater than 100 μm and equal to or less than 180 μm. When the driving distance is less than 100 μm, a state where the frictional heat E between the blade 72 and the secondary transfer roller 28 and the pressing force F of the blade 72 against the secondary transfer roller 28 act on the toner 100 and the medium component 200 that have entered the gap H is maintained, and thus the toner 100 may be stuck to the surface of the secondary transfer roller 28. In addition, when the driving distance exceeds 180 μm, the lateral side 72S of the blade 72 is pulled in a direction of the backward rotation of the secondary transfer roller 28, and thus may be worn out by the surface of the secondary transfer roller 28.

Therefore, the driving distance (rotation distance of the secondary transfer roller 28) of the backward rotation of the control section 20 is set to equal to or greater than 100 μm and equal to or less than 180 μm, and thus the sticking of the toner 100 to the surface of the secondary transfer roller 28 and the worn-out of the lateral side 72S of the blade 72 are effectively suppressed.

In addition, as described above, according to the configuration of the present exemplary embodiment, the sticking of the toner to the secondary transfer roller 28 is suppressed, and thus defective image quality caused by the sticking of the toner to the secondary transfer roller 28 is suppressed.

Modified Example

In the present exemplary embodiment, a reference elapsed time and a reference continuous rotation time are changed in accordance with an environmental temperature, but the present invention is not limited thereto. The backward rotation of the secondary transfer roller 28 may be controlled using one predetermined elapsed time and one predetermined continuous rotation time, regardless of an environmental temperature.

In the present exemplary embodiment, when the continuous rotation time of the secondary transfer roller 28 is equal to or more than a reference rotation time, the secondary transfer roller 28 is rotated backward, but the present invention is not limited thereto. The backward rotation of the secondary transfer roller 28 may be always performed after the termination of the transfer operation, regardless of the continuous rotation time of the secondary transfer roller 28.

In the present exemplary embodiment, the blade 72 formed of an elastic material is used as an example of a removing member, but the present invention is not limited thereto. As an example of the removing member, for example, a plate-shaped scraper formed of a metal material (for example, stainless steel) may be used. Meanwhile, the scraper may be formed of a metal material other than stainless steel.

The present invention is not limited to the above-described exemplary embodiment, and various modifications, changes, and improvements may be made without departing from the scope of the invention. For example, the plural modified examples described above may be appropriately combined with each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer member that transfers a toner image from an intermediate transfer body to a recording medium;

a removing member that includes a corner portion coming into contact with the transfer member, so as to remove a toner attached to the transfer member by rotation of the transfer member in a first direction; and a driving section that rotates the transfer member in the first direction and rotates the transfer member in a second direction opposite to the first direction.

2. The transfer device according to claim 1, wherein when a continuous rotation time in the first direction in a transfer operation of the transfer member is equal to or more than a predetermined time, the driving section rotates the transfer member in the second direction after the transfer operation is terminated.

3. The transfer device according to claim 2, wherein the driving section employs a first time as the predetermined time at a first environmental temperature, and employs a second time longer than the first time as the predetermined time at a second environmental temperature lower than the first environmental temperature.

4. The transfer device according to claim 1, wherein when the transfer member transfers the toner image having no blank portion in a margin thereof to the recording medium, the transfer member is rotated in the second direction after a transfer operation of the transfer member is terminated.

5. The transfer device according to claim 1, wherein the transfer member is a roller.

6. The transfer device according to claim 1, wherein the toner image has a size larger than a size of the recording medium.

7. The transfer device according to claim 1, wherein the driving section rotates the transfer member in the second direction after a transfer operation of the transfer member is terminated.

8. The transfer device according to claim 1, wherein the removing member has a hardness higher than a hardness of the transfer member.

9. An image forming apparatus comprising:

a forming section that forms a toner image;

an intermediate transfer body to which the toner image formed by the forming section is transferred; and a transfer device including a transfer member that transfers the toner image from the intermediate transfer body to a recording medium, a removing member that includes a corner portion coming into contact with the transfer member, so as to remove a toner attached to the transfer member by rotation of the transfer member in a first direction, and a driving section that rotates the transfer member in the first direction and rotates the transfer member in a second direction opposite to the first direction.

10. The image forming apparatus according to claim 9, wherein when a continuous rotation time in the first direction in a transfer operation of the transfer member is equal to or more than a predetermined time, the driving section rotates the transfer member in the second direction after the transfer operation is terminated.

11. The image forming apparatus according to claim 10, wherein the driving section employs a first time as the predetermined time at a first environmental temperature, and employs a second time longer than the first time as the predetermined time at a second environmental temperature lower than the first environmental temperature.

12. The image forming apparatus according to claim 9, wherein when the transfer member transfers the toner image having no blank portion in a margin thereof to the recording medium, the transfer member is rotated in the second direction after a transfer operation of the transfer member is terminated.

13. The image forming apparatus according to claim 9, wherein the driving section rotates the transfer member in the second direction after a transfer operation of the transfer member is terminated.

14. The image forming apparatus according to claim 9, wherein the removing member has a hardness higher than a hardness of the transfer member.

* * * * *